United States Patent [19]

Williams

[11] Patent Number: 4,491,484

[45] Date of Patent: Jan. 1, 1985

[54] CRYOGENIC CLEANING PROCESS

[75] Inventor: Roger F. Williams, Louisville, Ky.

[73] Assignee: Mobile Companies, Inc., Ky.

[21] Appl. No.: 513,742

[22] Filed: Jul. 14, 1983

Related U.S. Application Data

[62] Division of Ser. No. 324,530, Nov. 24, 1981, Pat. No. 4,409,034.

[51] Int. Cl.[3] ..... B08B 7/04; B08B 9/08

[52] U.S. Cl. ..... 134/4; 134/8; 134/17; 134/38; 134/40; 241/DIG. 37

[58] Field of Search ..... 134/4, 6, 8, 17, 22.1, 134/38, 40; 210/922, 925; 241/DIG. 37

[56] References Cited

U.S. PATENT DOCUMENTS

| | | | |
|---|---|---|---|
| 661,873 | 11/1900 | Hopcroft . | |
| 1,191,451 | 7/1916 | Morterud . | |
| 1,978,204 | 10/1934 | Hurt | 18/52 |
| 2,259,644 | 10/1941 | Kling . | |
| 2,347,464 | 4/1944 | Cuno | 260/758 |
| 2,402,967 | 7/1946 | Lubenow | 51/282 |
| 2,854,360 | 9/1958 | Pajes | 134/15 |
| 3,182,669 | 5/1965 | Campbell et al. . | |
| 3,419,427 | 12/1968 | Plock | 134/4 |
| 3,436,263 | 4/1969 | Strenkert et al. . | |
| 3,453,221 | 7/1969 | Richart | 260/2.5 |
| 3,527,414 | 9/1970 | Schorsch | 241/23 |
| 3,536,529 | 10/1970 | Fiocco . | |
| 3,614,873 | 10/1971 | Cole et al. | 62/66 |
| 3,741,804 | 6/1973 | Stapleton | 134/3 |
| 3,745,125 | 7/1973 | Marranci et al. | 210/925 X |
| 3,746,023 | 7/1973 | Smith . | |
| 3,774,855 | 11/1973 | Wolf | 241/65 |
| 3,785,575 | 1/1974 | Langmaack et al. | 241/33 |
| 3,856,667 | 12/1974 | Azarowicz | 210/922 X |
| 3,914,132 | 10/1975 | Sutton . | |
| 3,995,816 | 12/1976 | Motek | 241/23 |
| 4,011,159 | 3/1977 | Stein et al. | 134/4 X |
| 4,025,990 | 5/1977 | Lovette, Jr. | 241/14 |
| 4,043,140 | 8/1977 | Wendt et al. | 62/66 |
| 4,102,503 | 7/1978 | Meinass | 241/18 |
| 4,157,016 | 6/1979 | Wendt et al. | 62/123 |

*Primary Examiner*—Marc L. Caroff

*Attorney, Agent, or Firm*—Cushman, Darby & Cushman

[57] ABSTRACT

A cryogenic liquid is used to directly or indirectly cool solid or liquid contaminants adhering to apparatus surfaces to effect a change in the physical characteristics of the contaminants and thereby render them more susceptible to removal operations. The direct technique contemplates providing a source of liquid cryogen, contacting the liquid cryogen from the source thereof directly with the contaminated surfaces of the apparatus to effect at least a partial bonding separation from the apparatus surface, and effectively removing the contaminant material, while the indirect technique contemplates utilizing an existing system for circulating heated fluid within the apparatus by preventing the flow of hot fluid into the existing conduit channels, selectively and removably coupling adjacent conduit channels to effect a change of flow from a series flow pattern to a parallel flow pattern, permitting cryogenic liquid to flow into the conduit channels, allowing cryogenic liquid to circulate therein for a predetermined period of time to effect a manageable property change of the contaminant material, and removing the contaminant material therefrom.

15 Claims, 7 Drawing Figures

Fig. 1
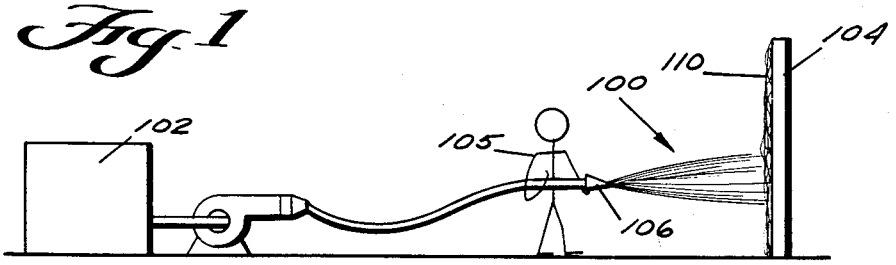
Fig. 2
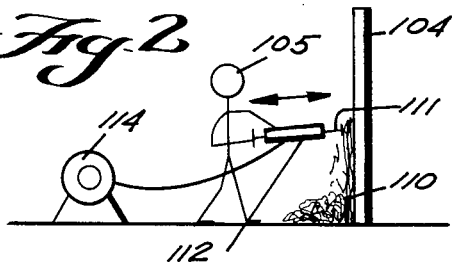
Fig. 3
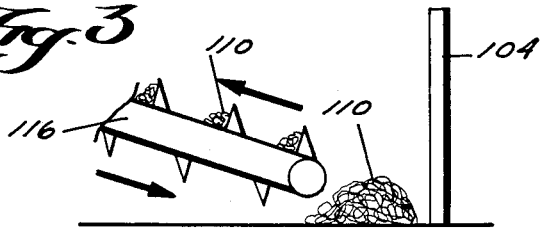
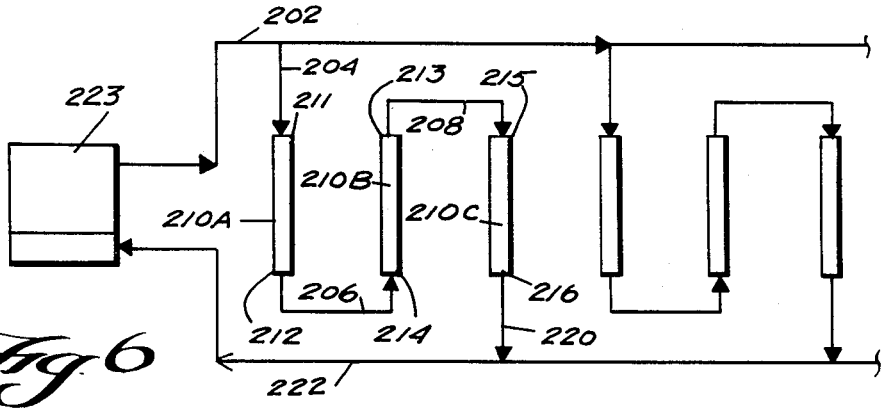
Fig. 6
Fig. 7
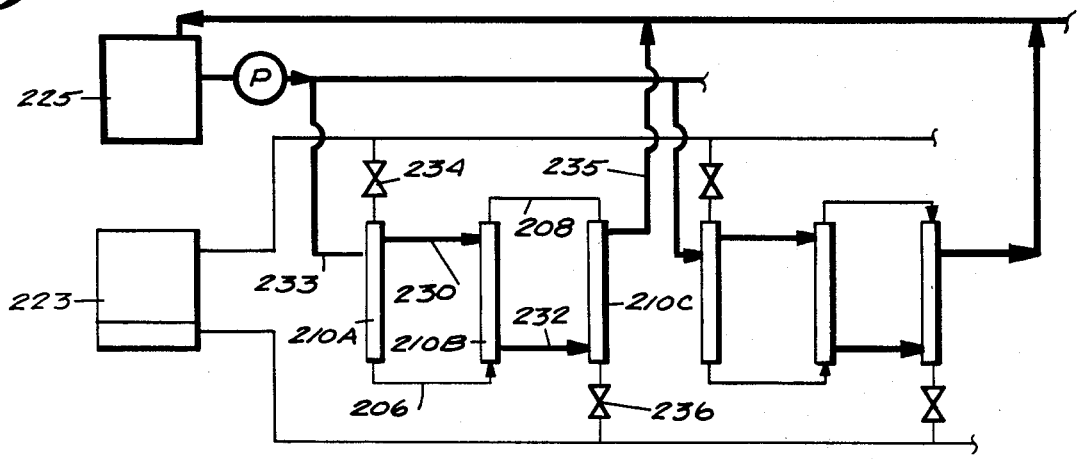

CRYOGENIC CLEANING PROCESS

CROSS-REFERENCE TO RELATED APPLICATIONS

This application is a division of application Ser. No. 324,530 filed Nov. 24, 1981, now U.S. Pat. No. 4,409,034.

BACKGROUND OF THE INVENTION

The present invention generally relates to a method and apparatus for cleaning contaminant material from structural surfaces. More particularly, the present invention relates to cleaning residual contaminant material from the surfaces of a structure by directly or indirectly utilizing a cryogenic or refrigerant liquid.

Cryogenics is the branch of science dealing with properties and effects of materials at very low temperatures. Cryogenic technology has found widespread industrial use in such applications as surgery, life-support systems for outer space environments, vacuum systems, superconductive devices, preservation of food and certain biological matter, and as missile propellant systems, to name a few. Generally, cryogenic technology utilizes gaseous substances which have been liquified by maintaining the gases under constant increased pressure above the triple point of the gases. The triple point of a substance is that pressure and temperature at which three different phases of one substance can coexist in equilibrium.

Bulk transporation or storage of liquid or viscous materials, such as, for example, petroleum products, polymer resins, organic chemicals or the like, pose certain problems for the operator of transporation or storage facilities. In particular, it is necessary for the operators of the bulk transportation equipment to be able to off-load the cargo quickly and to efficiently load new cargo such that idle time during the off-loading and on-loading operations is minimized. The equipment utilized by these facilities will, thus, be maintained in commerce and will be productive by minimizing the idle time.

However, a transporter of bulk materials as described above has particular problems when it is desired to off-load one type or quality of material and subsequently on-load a material of different type or quality. For example, it may be desirous to off-load a low quality petroleum product, such as coal tar and, subsequently, load a higher grade of petroleum product or the like. Therefore, it is extremely important that the transporting equipment be cleaned as thoroughly as possible so that the contamination of the newly on-loaded material is minimized.

It has been proposed that certain cleaning methods and techniques be utilized to clean transport equipment. For example, cleaning solvents and chemical cleaning solutions have been proposed, such as, for example, those disclosed in U.S. Pat. Nos. 3,436,263, 3,536,529, and 3,914,132. It has also been proposed to contact and remove contaminating material by utilizing water and/or steam as disclosed in U.S. Pat. Nos. 3,182,669 and 3,746,023.

A distinct problem associated with utilizing the chemical solvent technique of cleaning surfaces, and especially those surfaces in a cargo hold or the like in bulk transport equipment, is that certain of the chemicals may be expensive or could be hazardous to the person operating or performing the cleaning operation.

Additionally, the chemical solvent or water techniques for cleaning surfaces in a cargo hold may not be adaptable for certain chemical or viscous materials, such as, for example, polyresins, inorganic resins, petroleum products and by-products or the like.

Cryogenic liquids, such as liquid carbon dioxide ($CO_2$) and liquid nitrogen ($N_2$) have been proposed to be sprayed upon environmental oil spills in order to mitigate the environmental impact and damage from such oil spills. Such methods and apparatus for applying the liquid cryogen to the uncontrolled oil spills have been disclosed in U.S. Pat. Nos. 3,614,873, 4,043,140 and 4,157,016.

Generally, the cryogenic cleaning methods applied to environmental oil spills utilize an apparatus which applies the cryogenic material and subsequently removes a combination of frozen oil and substrate upon which the oil is associated. For example, in U.S. Pat. No. 4,043,140 a method and apparatus are disclosed whereby an oil spill on a beach is frozen when sprayed with liquid cryogen. Subsequently, the apparatus removes the combination of frozen oil and beach sand and separates the two components. In U.S. Pat. No. 3,614,873, a similar apparatus is disclosed which sprays cryogen material on an oil spill occurring on a body of water. The cryogen freezes the oil floating on the surface of the water and is subsequently skimmed from the water surface by the apparatus disclosed.

SUMMARY OF THE INVENTION

As will become apparent, attempts at mitigating the effects of uncontrolled environmental oil spills are not adaptable to the cleaning of liquid and viscous materials which may contaminate the surfaces of a particular article or the cargo holds of a vessel. Therefore, according to the present invention, there is disclosed a method and apparatus which facilitate the cleaning of surfaces from such liquid or viscous contaminant materials by utilizing a cryogenic or refrigerant liquid. The application of the liquid cryogenic or refrigerant will cause the contaminant material to undergo a change in property thereby releasing the occulsive bond that may be securing it to the surfaces to be cleaned leaving them substantially free from the contaminant material.

According to the present invention a relatively inexpensive and efficient method of cleaning surfaces of contaminant material is disclosed. Additionally, the idle time normally associated with conventional cleaning methods and techniques is greatly reduced enabling the equipment opertor to efficiently utilize available equipment.

Hazards of utilizing chemical solvents or steam to clean the surfaces of a contaminantd article are obviated according to the present invention thereby promoting safety to the person performing the cleaning operation. The method according to the present invention is fast and economical in terms of labor and material needed to effectively clean a contaminantd surface. For example, the number of vessels or equipment that can be cleaned in a predetermined time period could be increased by utilizing the present invention. Therefore, by utilizing the method according to the present invention, substantial monetary savings for the cost of labor can be realized by more efficiently utilizing the labor of the operators performing the cleaning operations.

Other advantages and benefits of utilizing the present invention will become more readily apparent to one of average skill in the art upon reading the detailed description of the invention which follows.

While reference may be made to vessels, holding tanks, tank cars (either railroad or truck), or the like, it should be particularly understood that the present invention can be satisfactorily and advantageously utilized for cleaning contaminant material from the surfaces of other structures or articles. Therefore, the present discussion should not be construed to be limited to bulk transportation equipment, bulk containing equipment or other such similar structures. As presently conceived, the present invention is particularly adaptable to cleaning the surfaces of various articles or structures and for application to the particular structures discussed herein. However, other applications may become readily apparent to one of average skill in the art and should be considered to be within the spirit and scope of the present invention and the appended claims.

BRIEF DESCRIPTION OF THE DRAWINGS

FIGS. 1 through 3 depict an exemplary embodiment of the direct application technique according to the present invention;

FIG. 6 is a schematic representation of a conventional heating system normally utilized in bulk transport vehicles; and FIG. 7 is a schematic representation of the modifications to the system shown in FIG. 6 according to the present invention.

DETAILED DESCRIPTION OF THE INVENTION

Figure 4:
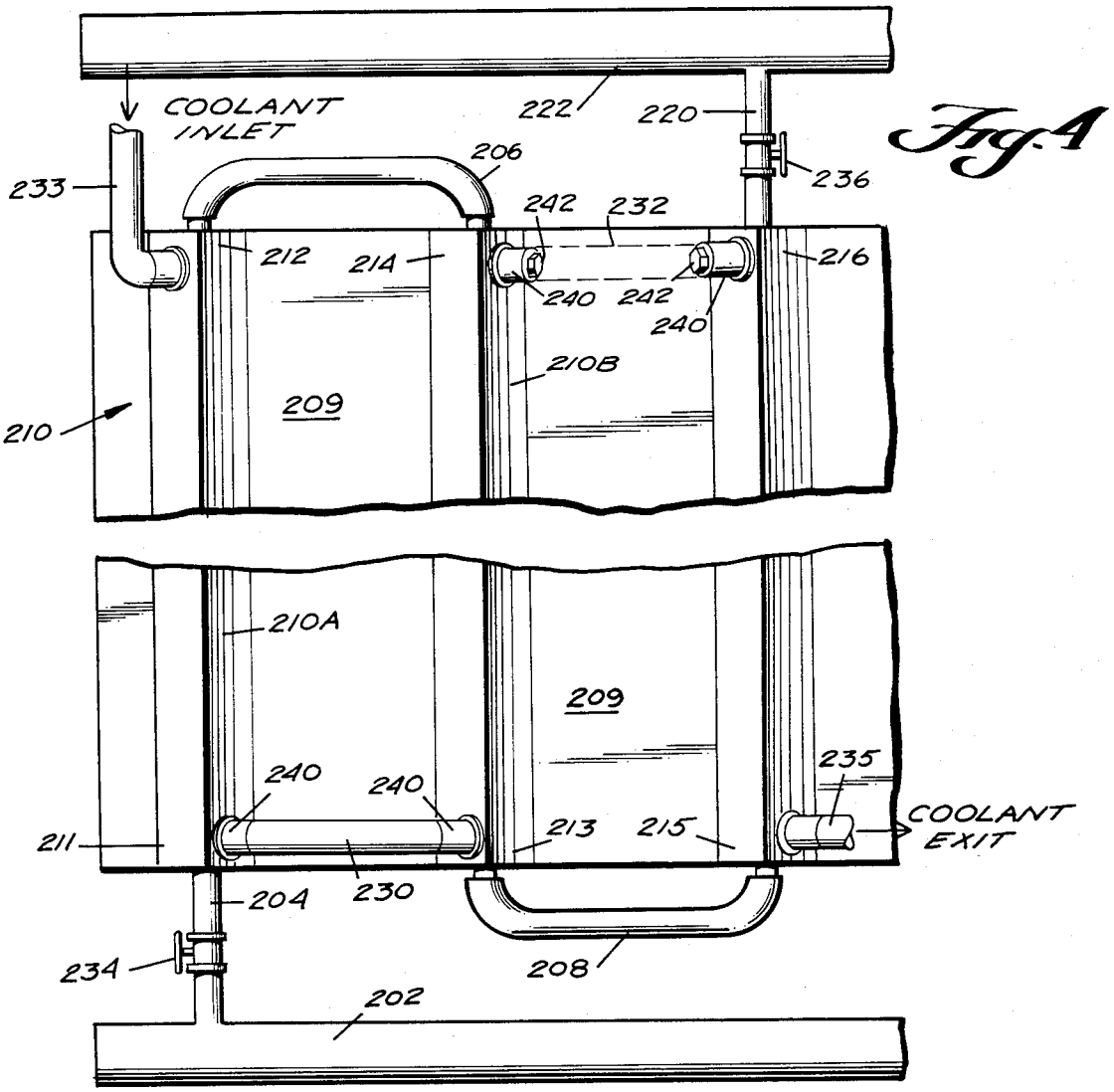
FIG. 4 is a bottom view of an embodiment of the apparatus according to the present invention.

The present invention generally relates to a method of cleaning contaminant material from the surfaces of equipment or articles by utilizing cryogenic or refrigerant liquids. More specifically, the present invention relates to a method of cleaning surfaces of a container vessel, such as, for example, a barge, ocean going vessel, tank car, holding tank or the like by a direct and an indirect technique of application. Therefore, the following detailed description of the invention is subdivided into the categories of direct application and indirect application techniques.

I. Direct Application Technique

In a preferred embodiment of the present invention, the cryogenic liquid may be contacted directly with the contaminant material which is adhered on the surface of the article to be cleaned so that the contaminant material will be rendered more workable and more adaptable to facilitate efficient removal. The direct application technique is particularly useful when applied to contaminant substances which are viscous, elastic or tacky in nature. It will be appreciated that such contaminant substances tend to cling to the surfaces of the article intended to be cleaned and form an occlusive bond to the article's surface which renders removal of the material by conventional methods extremely difficult.

The direct application technique of the cryogenic material to the contaminated surfaces intended to be cleaned generally comprises providing a source of liquid cryogen; contacting the liquid cryogen from the source directly with the contaminated surfaces of the apparatus to effect at least a partial bonding separation from the apparatus surface; and removing the contaminant material to effect a surface substantially free from contaminant material.

The source of liquid cryogen can be, for example, liquid nitrogen or carbon dioxide. Preferably, liquid carbon dioxide ($CO_2$) is utilized due to its overall advantageous cost effectiveness and commercial market availability. However, liquid nitrogen ($N_2$) can be advantageously utilized in place of the liquid carbon dioxide while maintaining the beneficial effects of the present invention.

The carbon dioxide is generally maintained in a storage facility under pressure and at extremely reduced temperatures. The increased pressures and reduced temperatures necessary to liquify gaseous carbon dioxide are dictated by its inherent thermal properties. Therefore, the reservoir for the liquid cryogen can be any suitable structure or apparatus which maintains the cryogen in the liquid state such as, for example, refrigeration systems which absorb or extract heat, Joule-Thomson systems or the like. In this regard, attention is directed to Perry's Chemical Engineer Handbook, 4th Edition at pages 3-158 and 3-181 which disclose the thermodynamic properties of carbon dioxide and nitrogen in temperature-entropy diagrams.

The liquid cryogen can be transferred from the cryogen reservoir to the surface of the contaminated structure by any suitable apparatus, such as, for example, pumps or other similar transfer mechanisms. However, since the liquid cryogen will be stored in the reservoir and maintained at temperatures of about −100° C. to about −130° C., care should be taken to provide the wetted portions of the storage reservoir apparatus and transfer apparatus with suitable materials to withstand such extreme depressed temperatures.

As noted above, the temperature range of the liquid cryogen is preferably in the range of about −100° C. to about −120° C. However, temperatures of less than −120° C. are conceivable and are limited only with respect to the economic aspects of maintaining the cryogen at such extreme depressed temperatures. For example, at temperatures of less than −120° C., the size of the equipment necessary to maintain the cryogen in a liquid phase may be cost prohibitive.

Referring to FIGS. 1 through 3, it can be seen that the liquid cryogen 100 according to the method of the present invention is preferably sprayed from a source 102 of liquid cryogen onto the contaminated surface 104 to be cleaned. The liquid cryogen can be sprayed by an opertor 105 using a suitable apparatus, such as, a spray nozzle or the like. Certain cleaning applications, such as cleaning contaminant substances of heavy viscous coal tars or the like, may require that the liquid cryogen be injected into the contaminant substance. The injection of the liquid cryogen into the contaminant substance may be effected by penetrating the surface of the contaminant substance in at least one predetermined location. Of course, the number of penetrations will depend upon the area of the surface to be cleaned and the properties of the contaminant substance. Injection of the liquid cryogen can be accomplished by any suitable apparatus, such as, for example, an injection nozzle or the like.

The contaminant material 110 rapidly changes properties when contacted with the liquid cryogen such that the viscous or tacky contaminant material becomes more workable and more adaptable for efficient removal. It is theorized that the rapid change in properties of the contaminant material 110 causes it to contract at a more rapid rate than the surface 104 of the article being cleaned. In such a manner, the occulsive bond between the contaminant material and the surface may be at least partially withdrawn which permits the contaminant material to be more easily removed. While there may be some thermal contraction of the surface of the article being cleaned, such contraction is negligible when compared to the contraction of the contaminant material when contacted with liquid cryogen according to the present invention.

The method according to the present invention may be advantageously utilized to clean articles upon which is bonded a dried or solidified contaminant material, such as, for example, dried or solidified paint. The dried paint will undergo a change in property when contacted directly with the liquid cryogen such that removal from the article being cleaned is substantially facilitated.

The amount of liquid cryogen applied is, in general, a function of the contaminant material existing on the surface to be cleaned and is thus, dictated by the competing economics involved. Therefore, certain contaminant materials (e.g. dried paint) may become frozen or embrittled when contacted with the liquid cryogen. Other contaminant materials which have increased densities such that they are viscous or tacky in nature (e.g. coal tar, viscous resin or the like), may experience a change in property which renders them less viscous or tacky. In such a manner, these viscous or tacky materials, while not necessarily being frozen, will be rendered more workable and more adaptable to removal when compared to their normal state.

Removal of the contaminant material which has been contacted with the liquid cryogen according to the present invention can be effectively accomplished by a variety of techniques as can be more clearly seen referring to FIGS. 2 and 3. Preferably, a manual or automatic vibration technique is utilized such that any contaminant material 110 which exists on the surface 104 will be loosened and removed. Often, the use of vibration techniques will cause the cryogenically treated contaminant substance to become substantially comminuted. The comminuted contaminant substance can therefore be easily removed from the surface of the article. As way of example only and as a nonlimiting technique, a reciprocal vibration apparatus 112 using compressed air supplied by a compressor 114 can be utilized by directly contacting the reciprocating arm of the apparatus 112 with the surface 104 of the article being cleaned so that a vibration force can be imparted.

The collected contaminant material 110 can subsequently be removed by suitable manual or mechanical techniques. For example, a conveyor 116 can be utilized to transfer the contaminant material 110 to a suitable collection site. Alternatively, a shovel or hydraulic scoop could be advantageously utilized. When the contaminant material is the kind which will become frozen or embrittled when contacted with the liquid cryogen, an advantageous method of removing the comminuted contaminant material relates to utilizing vacuum transferring devices. Such devices utilize a vacuum hose or the like which accepts the contaminant material and transfers it to a suitable collection site.

Since certain contaminant material 110 will not comminute upon the application of vibrational force (e.g. the more dense or viscous materials), the method according to the present invention contemplates that the removal of such materials can be accomplished by utilizing a reciprocal apparatus having a wedge-like longitudinal attachment. The contaminant material can then be chipped or peeled from the surface of the article subsequent to the application of the cryogenic liquid.

In either instance, the contaminant substance will be effectively loosened and can subsequently be transferred to a suitable waste receiving structure or site by conveyor or other solid handling devices. Removal of the solidified contaminant can also be done manually by shovel or any convenient and economical technique.

II. Indirect Application Technique

The indirect application technique of the present invention generally contemplates utilizing existing piping systems conventionally utilized in cargo transferring equipment, such as, for example, barges, ocean vessels, railroad and truck tank cars or the like.

Conventional transporting equipment for liquid or viscous cargos generally utilize a system for transferring heat to the cargo so that it will remain in a liquid or viscous phase during transportation. Normally, the heating system uses steam which passes through a piping system such that heat is transferred to the cargo through the walls of the pipe or through the surfaces of the transportation structure. In such a manner, the liquid or viscous cargo is maintained in a suitable phase for transportation. The maintenance of the cargo in the liquid or viscous phase during transporation is particularly important in colder regions and during winter months where there is a possibility of cargo solidification during the transportation process.

While the heated indirect system for maintaining the cargo in liquid phase during transportation is advantageous when the cargo is being transported, the liquid and viscous residue remaining in the transportation structure after the cargo has been off-loaded can pose problems when the structure is cleaned. It has been found that it is insufficient to merely shut down the heating system and clean the cargo holds according to conventional methods, such as, for example, washing the surfaces with solvents or with direct steam cleaning as previously discussed. Such treatments for the cleaning of surfaces can be time consuming and, additionally, could pose health hazards to the cleaning operator.

However, according to the present invention, an apparatus and method are provided which enable the introduction of a liquid cryogenic or refrigerant into the conventional heating system piping so that the residue of the cargo after it has been off-loaded can be effectively cleaned.

Figure 5:
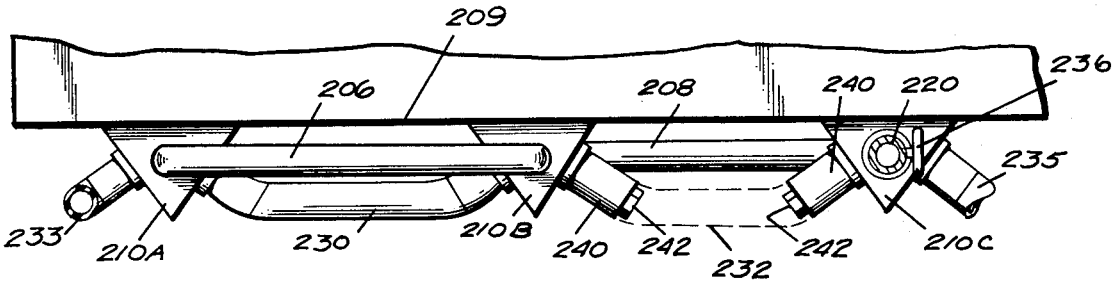
FIG. 5 is a side view of the embodiment depicted in FIG. 4.

Referring now more specifically to FIGS. 4 and 5, it can be seen that the apparatus according to the present invention generally comprise channels 210 which accept and direct the heated fluid. The heated fluid, preferably steam or water at an elevated temperature, is supplied by a header 202 which has a branch line 204 extending to the first channel 210A.

The heated fluid passes from the first channel 210A to the second channel 210B in a series flow arrangement by passing through a first interconnecting conduit 206 which is positioned in such a manner that the fluid exit end 212 of the first channel 210A and the fluid entrance end 214 of the second channel 210B are interconnected. The heated fluid may then flow through the second channel 210B and be transferred to the third channel 210C in a series flow arrangement by passing through a second interconnecting conduit 208. The second interconnecting conduit 208 is connected between the second and third channels 210B and 210C, respectively, in such a manner that the fluid exit end 223 of the second channel 210B and the fluid entrance end 215 of the third channel 210C are interconnected. At the fluid exit end 216 of the third channel 210C, there is provided an exit branch conduit 220 which is connected to the heated fluid return header 222. The return header 222 returns the heating fluid to a common source, such as, for example, a boiler (shown at 223 in FIGS. 6 and 7) or the like so that the fluid can once again be elevated in temperature and the cycle repeated. A schematic representation of the conventional heating system can be more clearly seen referring to FIG. 6.

It should be appreciated that as the heated liquid flows through the plurality of channels 10, heat is transferred from the fluid to the material contained in the transporting structure by way of the heat transfer coefficients of the channels and the structure compartment 209. Therefore, the fluid must be returned to a conventional apparatus for reheating so that it can be subsequently recycled to the fluid entrance end 211 of the first channel 210A. In such a manner, the liquid or viscous material contained in the transporting structure compartment can be maintained in the proper phase and is prevented from solidifying due to cold climate conditions.

According to the present invention, there is provided a modification which generally changes the flow pattern in the channels 210 from a series flow arrangement to a parallel flow arrangement as can be seen in FIG. 7. This modification is generally accomplished by additional channel interconnecting conduits 230, 232. The interconnecting channel conduits 230, 232 are preferably located opposite the existing interconnecting conduits 206 and 208 in such a manner that the flow of the liquid cryogenic or refrigerant from a source 225 will be a parallel rather than a series flow arrangement.

Referring now more particularly to FIGS. 4 and 5, it can be seen that a third interconnecting conduit 230 between the first channel and the second channel 210B is located at the fluid entrance end 211 of the first channel 210A and the fluid exit end 213 of the second channel 210B in such a manner that it is connecting the opposite ends of the first interconnecting conduit 206. Similarly, the second and third channels 210B and 210C, respectively, are interconnected by providing a fourth interconnecting conduit (shown in dotted line at 232 in FIGS. 4 and 5) located at the fluid entrance end 214 of the second channel 210B and the fluid exit end 216 of the third channel 210C.

Additionally, there is provided a supply conduit 233 for the liquid cryogenic or refrigerant flowing from a source 225. Preferably, the supply conduit 233 is connected to the first channel 210A in such a manner that the liquid cryoenic or refrigerant will be transferred into the first channel 210A and directed in a parallel flow arrangement as previously discussed.

In order to selectively engage the cryogenic or refrigerant system, it should be understood that the flow of heating fluid must be completely stopped. According to the present invention, this is accomplished by providing suitable block valves 234 and 236 or the like respectively located in the branch conduit 204 between the heated fluid supply header 202 and the first channel 210A, and, additionally, in the branch conduit 220 between the third channel 210C and the return header 222. Thus, when it is desired to introduce the liquid cryogenic into the channels, the heating fluid supply and return systems can be completely isolated by closing the suitable block valves 234, 236 thereby preventing the flow of cryogenic or refrigerant liquid into the heated fluid system.

It should also be appreciated that the cryogenic or refrigerant liquid interconnecting conduits 230 and 232 must be removed when the heating fluid system is desired to be put into operation. According to the present invention, this can be accomplished by providing flanges 240 which would preferably have a block valve or a suitable structure, such as a male threaded plug 242 for engagement with female threads of the flange 240 so that the opening to the channel can be effectively closed and the interconnecting conduit 230 and 232 removed prior to the operation of the heating fluid system. Additionally, the cryogenic or refrigerant supply conduit 233 and exit conduit 235 can be removably coupled to the first channel 210A and last channel 210C, respectively, in a similar manner.

It should be pointed out that the apparatus depicted in FIGS. 4 and 5 is representative of only one structural arrangement which can satisfactorily utilize the present invention. Although only three channels 210A, 210B and 210C are depicted, it should be understood that the number of channels and the arrangement of the piping system is dependent upon the vessel size and the heated fluid utilized. Therefore, a plurality of channels may satisfactorily be utilized according to the present invention.

The method according to the present invention generally contemplates utilizing the steps of:

(a) preventing the flow of hot fluid into the existing conduit channels;

(b) selectively and removably coupling adjacent conduit channels by utilizing adequate conduits to effect a change of flow from a series flow pattern to a parallel flow pattern;

(c) permitting cryogenic fluid to flow in the conduit channels modified according to step (b);

(d) allowing the cryogenic fluid to circulate in the conduit channel for a predetermined period of time to effect a more manageable change in properties of the contaminant material; and (e) removing the contaminant material manageably changed according to step (d).

The indirect method of cleaning surfaces of a structure is similar in nature to the direct method except that the heat transfer coefficients of the material of the structure are utilized to transfer the heat from the contaminant material to the cryogenic liquid. In such a manner, the contaminant material is changed from its inherent liquid or semi-liquid viscous properties to a more manageable property which facilitates removal. Certain contaminant material may become frozen or solidifed while other contaminant material may undergo a change in property such that it becomes less viscous or tacky in nature. Thus, the contaminant may be effectively removed from the surfaces of the structure by conventional methods, such as, vibration impacting or the like.

When the cleaning operation has been completed, the system can once again be returned to the heated liquid cycle. This can be accomplished by stopping the flow of coolant liquid flowing in a parallel flow pattern through the conduit channels; removing the conduits coupled to adjacent conduit channels according to step (b), above; and, allowing heated fluid to circulate in a series flow arrangement through the conduit channels. Of course, if block valves are utilized to stop the flow of heated fluid, the flow can be resumed by opening the valves or similar structures after the coolant liquid has been stopped and isolated.

While cryogenic material, such as, carbon dioxide ($CO_2$) and liquid nitrogen ($N_2$) are preferable, the advantages of the present invention can be satisfactorily realized when utilizing other available refrigerant materials. When cryogenic liquids are utilized, they should be in the range of about −120° C. to about −100° C. Removal of the contaminant material can be effected in the same manner as the direct application technique, such as vibration comminution, peeling, chipping or the like.

Additionally, it should be understood that although the drawings and discussion above are limited to a three channel system, the modification of a pluarlity of channels according to the present invention is intended to be within the scope of the appended claims and, therefore, the above discussion should not be viewed as a limiting factor.

While the above invention has been described in what is presently conceived to be the more preferable embodiments thereof, it will be apparent to those of ordinary skill in the art that many modifications may be made thereof within the scope of the invention, which scope is to be accorded the broadest interpretation of the appended claims so as to encompass all equivalent assemblies, structures, or methods.

What is claimed is:

1. A method of removing at least a major portion of a viscous liquid which remains, as contaminant material, upon the rigid surfaces of a cargo hold of an apparatus used to transport said viscous liquid, which method comprises the steps of:

(a) providing a source of liquid cryogen having a temperature of less than about −100° C.;

(b) withdrawing a supply of liquid cryogen from said source thereof and contacting said supply of liquid cryogen directly with at least one contaminated surface of the cargo hold to effect at least partial soldification of said contaminant material thereby effecting at least a partial bonding separation from said at least one cargo hold surface; and (c) effectively removing only the at least partially solidified contaminant material from said at least one cargo hold surface by impacting the at least partially solified contaminant material with sufficient force to effect substantial comminution thereof and to effect at least partial release of the comminuted contaminant material from said at least one cargo hold surface.

2. A method according to claim 1 wherein said liquid cryogen is liquid carbon dioxide.

3. A method according to claim 1 wherein said liquid cryogen is liquid nitrogen.

4. A method according to claim 1 further comprising the step of: (d) transferring the partially solidified contaminant material to a predetermined site.

5. A method according to claim 4 wherein step (d) is accomplished by vacuum.

6. A method according to claim 4 wherein step (d) is accomplished by mechanical means for transferring said contaminant material.

7. A method according to claim 1 wherein the contaminant material is coal tar.

8. A method according to claim 1 wherein the contaminant material is organic or inorganic resin.

9. A method according to claim 1 wherein the contaminant material is a petroleum product.

10. A method according to claim 2 wherein the temperature of the liquid carbon dioxide is between about −120° C. and about −100° C.

11. A method according to claim 2 wherein the temperature of the liquid carbon dioxide is about −120° C.

12. A method according to claim 1 wherein step (b) is practiced by spraying the liquid cryogen onto the contaminant material.

13. A method according to claim 1 wherein step (b) is practiced by injecting the liquid cryogen into the contaminant material.

14. A method according to claim 3, wherein the temperature of the liquid nitrogen is between about −120° C. and about −100° C.

15. A method according to claim 3 wherein the temperature of the liquid nitrogen is about −120° C.

* * * * *